US007750262B2

(12) United States Patent
Knoll et al.

(10) Patent No.: US 7,750,262 B2
(45) Date of Patent: Jul. 6, 2010

(54) ROCKER SWITCH

(75) Inventors: Christian Knoll, Stuttgart (DE); Ralf Nieschulz, Munich (DE); Hermann Kuenzner, Freising (DE); Jan Syring, Metzingen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 213 days.

(21) Appl. No.: 12/015,209

(22) Filed: Jan. 16, 2008

(65) Prior Publication Data

US 2008/0179174 A1 Jul. 31, 2008

(30) Foreign Application Priority Data

Jan. 16, 2007 (DE) ..... 10 2007 002 311

(51) Int. Cl.
*H01H 9/00* (2006.01)
*H01H 21/00* (2006.01)

(52) U.S. Cl. ..... 200/339; 200/5 R; 200/61.54; 200/296

(58) Field of Classification Search ..... 200/5 R, 200/6 A, 17 R, 18, 339, 1 B, 61.54, 296
See application file for complete search history.

(56) References Cited

U.S. PATENT DOCUMENTS

| | | | | |
|---|---|---|---|---|
| 3,329,785 | A | 7/1967 | Baer et al. | |
| 3,469,042 | A | 9/1969 | Sandor | |
| 3,958,090 | A | 5/1976 | Garcia | |
| 4,389,549 | A | 6/1983 | Brown | |
| 4,644,110 | A | 2/1987 | Watanabe et al. | |
| 4,816,631 | A * | 3/1989 | Yamashita et al. | 200/332 |
| 6,191,372 | B1 * | 2/2001 | Sasaki et al. | 200/1 R |
| 6,559,401 | B2 | 5/2003 | Minami et al. | |
| 6,580,045 | B1 | 6/2003 | Kuo | |
| 7,183,510 | B2 * | 2/2007 | Ami et al. | 200/302.3 |
| 7,268,305 | B2 * | 9/2007 | Schmidt et al. | 200/5 R |
| 7,297,884 | B2 * | 11/2007 | Shimizu et al. | 200/5 R |
| 7,358,453 | B2 * | 4/2008 | Tsunoda | 200/339 |
| 7,462,788 | B2 * | 12/2008 | Miyauchi | 200/5 R |
| 7,521,642 | B2 * | 4/2009 | Belanger | 200/339 |
| 7,572,995 | B2 * | 8/2009 | Hayakawa et al. | 200/339 |

FOREIGN PATENT DOCUMENTS

| | | |
|---|---|---|
| DE | 1 782 303 U | 2/1959 |
| DE | 1 783 262 U | 2/1959 |
| DE | 25 56 887 A1 | 6/1976 |

(Continued)

OTHER PUBLICATIONS

German Search Report dated Nov. 7, 2007 with English translation of relevant portion (Nine (9) pages).

*Primary Examiner*—Michael A Friedhofer
(74) *Attorney, Agent, or Firm*—Crowell & Moring LLP

(57) ABSTRACT

A rocker switch, particularly a window lift switch in a motor vehicle, has a switch housing in which a rocker lever can be adjusted from an initial position, against a restoring force, into a switch-on position. The rocker lever is disposed in the switch housing on one side. In the initial position, its surface forming the free end of the rocker lever is approximately flush with the surrounding areas of the switch housing, and, in the switch-on position, this surface protrudes out from the surrounding areas.

13 Claims, 2 Drawing Sheets

FOREIGN PATENT DOCUMENTS

| | | | |
|---|---|---|---|
| DE | 32 29 280 | A1 | 5/1983 |
| DE | 34 85 796 | T2 | 2/1993 |
| DE | 44 31 061 | A1 | 3/1996 |
| DE | 196 19 124 | A1 | 11/1997 |
| DE | 198 53 818 | A1 | 12/1999 |
| DE | 601 14 742 | T2 | 6/2006 |
| FR | 903.355 | | 1/1945 |
| GB | 1060579 | | 3/1967 |
| GB | 1134420 | | 11/1968 |

* cited by examiner

Switch position: pressed condition

Switch position: pulled condition

Switch position: neutral condition

ROCKER SWITCH

CROSS-REFERENCE TO RELATED APPLICATION

This application claims the priority of German Application No. 10 2007 002 311.3, filed Jan. 16, 2007, the disclosure of which is expressly incorporated by reference herein.

BACKGROUND AND SUMMARY OF THE INVENTION

The invention relates to a rocker switch, particularly a window lift switch in a motor vehicle, having a switch housing in which a rocker lever can be adjusted from an initial position against a restoring force into a switch-on position.

Motor vehicles are increasingly equipped with electrically operable window lift switches for two or all of the side doors, and even also for a rear door. As a rule, a separate window lift switch is provided for each door of the motor vehicle, which switch is operated by a push button or a rocker lever. The push buttons or rocker levers, which can be operated by the driver, are usually either accommodated on the covering of the driver's door or on the center console.

A rocker switch of the above-mentioned type is known from German patent document DE 19619124 A1. The rocker lever is disposed in the center and can be tilted toward both sides for carrying out a closing or an opening movement of the window lifter. In the event of a faulty operation, there is the risk of an accidental closing movement and of an unintended squeezing-in. This may even lead to a risk of injury.

The invention provides a rocker switch of the above-mentioned type, by which a clear and safe operability is ensured.

According to the invention, a rocker switch, particularly a window lift switch in a motor vehicle, includes a switch housing in which a rocker lever can be adjusted from an initial position against a restoring force into a switch-on position. On one side, the rocker lever is disposed in the switch housing and, with its surface forming the free end of the rocker lever, in the initial position, is approximately flush with the surrounding areas of the switch housing. In the switch-on position, this surface protrudes from the surrounding areas.

As a result of selecting the bearing of the rocker lever in connection with the design of the visible surfaces of the rocker lever and the switch housing, a uniform and unobtrusive appearance is achieved. This even applies when, as is customary in the case of window lift switches, several of such rocker switches are arranged side-by-side. If, as in the case of the invention, the surface of the rocker switch protrudes from the surrounding areas in the switch-on position, the user has the impression that he is pulling the rocker lever out of the operating surface. An operating surface is the surface which is represented by the surface of the rocker lever in its initial position and the surrounding areas.

Within the scope of the invention, the orientation of the operating surface can be freely selected. It may have a horizontal, vertical or even a diagonal direction.

The described impression of a "pulling-out" for the movement out of the operating surface carried out at the rocker lever will be particularly pronounced when the operating surface extends approximately horizontally and assuming that the rocker switch is situated below the user's eye level. The user's viewing direction extends from above or diagonally from above. When, in the case of a window lift switch, the switch-on position has the purpose of moving the window lifter into the closed position, a clear interrelationship is achieved between the switch movement and the window lifter movement.

The switch housing preferably has a reach-in opening by way of which one can reach under the free end of the rocker lever for the adjustment into the switch-on position. The described "pulling of the rocker lever out of the operating surface" is thereby facilitated.

It is particularly advantageous for the rocker lever to have a further switch-on position into which it can be moved against a restoring force and into which the surface dips with respect to the surrounding areas of the switch housing. In the case of a window lift switch, the opening movement of the window lifter can be controlled in an obvious manner. The dipping-in motion carried out by the rocker lever clearly corresponds with the lowering movement of the window lifter.

The rocker lever is advantageously bent in its course at right angles. When the rocker lever is operated, the interior construction of the rocker switch, such as its bearing and a printed circuit board interacting with the rocker lever, remain hidden.

It is preferably provided that the rocker switch forms a switch bank together with additional such rocker switches arranged in a common switch housing. In this case, the surfaces of the rocker switches are situated in one plane together with the adjacent surfaces of the switch housing.

Other objects, advantages and novel features of the present invention will become apparent from the following detailed description of the invention when considered in conjunction with the accompanying drawings.

DETAILED DESCRIPTION OF THE DRAWINGS

Figure 1:
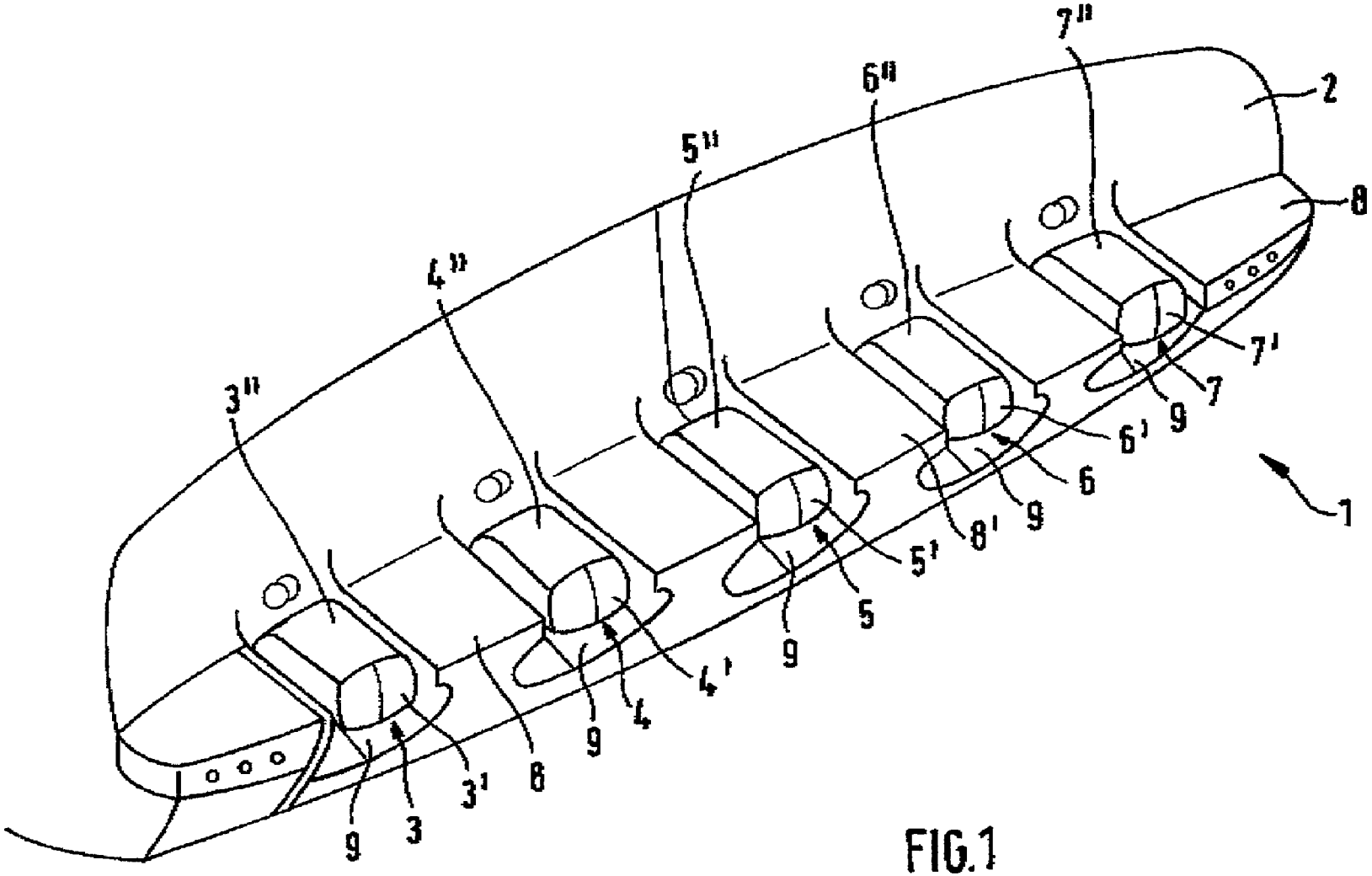
FIG. 1 is a perspective view of a switch bank having several rocker switches according to the invention.

The switch bank 1 illustrated in FIG. 1, in its switch housing 2, contains several rocker switches 3-7 having a visible rocker lever 3' to 7' as well as additional switch components, such as micro switches, printed switching circuit boards, and the like, which are not shown and cooperate with the respective rocker lever 3'-7'. In the illustrated example, the rocker switches 3 and 7 are used as window lift switches for the front side window on the left and right, respectively, in the driving direction; the rocker switches 4 and 6 are used for switching the fog lights in the front and the rear; and the rocker switch 5 is used for the locking/unlocking of the vehicle doors (not shown).

The invention provides an operating surface 8, which surrounds the visible surfaces (3" to 7") of the rocker levers 3' to 7', and partially encloses them. The rocker levers 3' to 7' move out of the operating surface 8 during their operation.

Figure 2C:
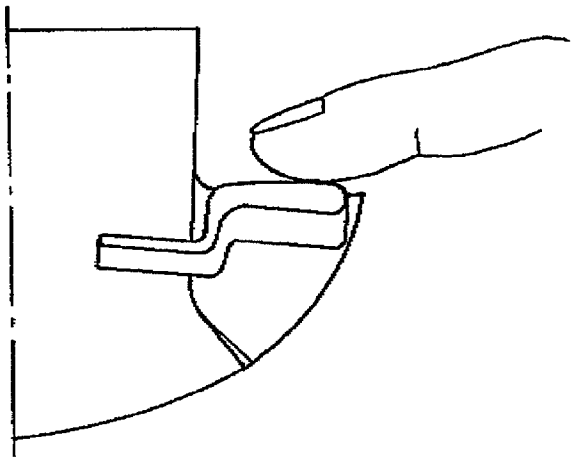
FIGS. 2*a*-2*c* are lateral views of one of the rocker switches of FIG. 1 in its various positions.
Figure 2B:
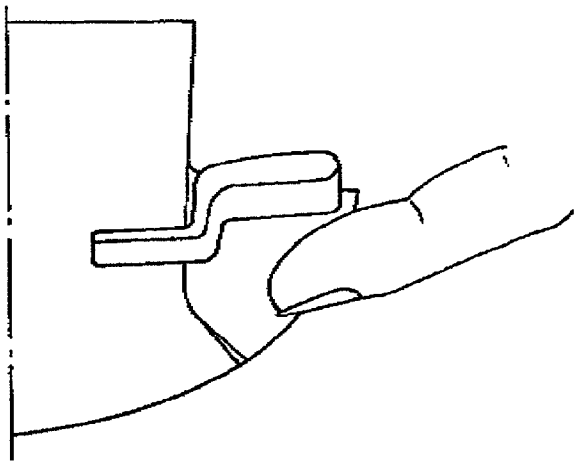
Figure 2A:
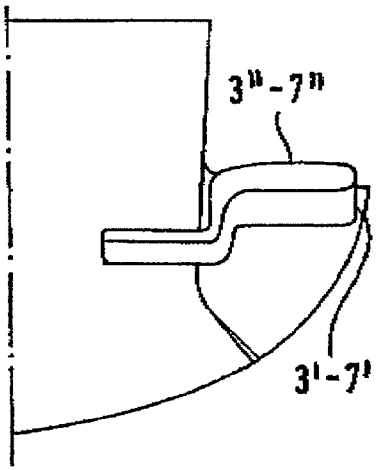

As illustrated in FIG. 2 via views 2*a* to 2*c*, the rocker levers 3' to 7' are bent at right angles.

The operating surface 8 is aligned horizontally. The rocker levers 3 and 7, starting from the initial position illustrated in FIG. 2*a*, during the upward rocking (closing of the windows, FIG. 2*b*) thereby move out of this surface 8 and, during the downward rocking (opening of the windows, FIG. 2*c*) dip into this surface 8. If the operating paths covered during the movement of the rocker lever 3, 7 are short, then a collision can be prevented between the operating fingers of the user and the static structures defining the operating surface 8. Also, the operating finger does not have to "dip through" between stationary surface elements. For facilitating the operation of the rocker levers 3-7, recesses 9 are provided in the switch housing 2 below these rocker levers 3-7, the operator's finger reaching into these recesses 9 during the upward rocking of the respective rocker lever.

This results in a rocker switch which, by itself and in connection with additional adjacent rocker switches, permits safe and clear control of the corresponding function elements.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rocker switch for a motor vehicle, the rocker switch comprising:

a switch housing; and a rocker lever, which is adjustable against a restoring force from an initial position into a switch-on position;

wherein a fixed end of the rocker lever is operatively disposed in the switch housing and is fixed to the switch housing, wherein a free end of the rocker lever has a surface which, in an initial position of the rocker switch, is approximately flush with a surface of a surrounding area of the switch housing, wherein a longitudinal axis of the fixed end of the rocker lever is substantially parallel to a longitudinal axis of the free end of the rocker lever, and wherein in the switch-on position, the surface of the free end of the rocker lever protrudes out of the surrounding area of the switch housing.

2. The rocker switch according to claim 1, further comprising a reach-in opening formed in the switch housing;

wherein an operator may reach under the free end of the rocker lever for adjusting the switch-on position.

3. The rocker switch according to claim 2, wherein the rocker lever has a second switch-on position into which it is movable against a restoring force, the surface of the free end of the rocker lever dipping into the surrounding area of the switch housing in the second switch-on position.

4. The rocker switch according to claim 3, wherein the rocker lever is bent at a right angle with respect to at least one of the longitudinal axis of the free end of the rocker lever and the longitudinal axis of the fixed end of the rocker lever.

5. The rocker switch according to claim 2, wherein the rocker lever is bent at a right angle with respect to at least one of the longitudinal axis of the free end of the rocker lever and the longitudinal axis of the fixed end of the rocker lever.

6. The rocker switch according to claim 1, wherein the rocker lever has a second switch-on position into which it is movable against a restoring force, the surface of the free end of the rocker lever dipping into the surrounding area of the switch housing in the second switch-on position.

7. The rocker switch according to claim 6, wherein the rocker lever is bent at a right angle with respect to at least one of the longitudinal axis of the free end of the rocker lever and the longitudinal axis of the fixed end of the rocker lever.

8. The rocker switch according to claim 1, wherein the rocker lever is bent at a right angle with respect to at least one of the longitudinal axis of the free end of the rocker lever and the longitudinal axis of the fixed end of the rocker lever.

9. A rocker switch according to claim 1, wherein the rocker switch is a window-lift switch for a window of the motor vehicle.

10. A switch bank for a motor vehicle, the switch bank comprising:

a common switch housing; and a plurality of rocker switches arranged in the common switch housing, wherein each rocker switch includes a rocker lever that is adjustable against a restoring force from an initial position into a switch-on position;

wherein a fixed end of each rocker lever is disposed in the switch housing and is fixed to the switch housing, wherein a free end of each rocker lever has a surface which, in an initial position of the rocker switch, is approximately flush with a surface of a surrounding area of the switch housing;

wherein a longitudinal axis of the fixed end of each rocker lever is substantially parallel to a longitudinal axis of the free end of the rocker lever, wherein in the switch-on position, the surface of the free end of each rocker lever protrudes out of the surrounding area of the switch housing; and wherein the surfaces of the free ends of the plurality of rocker switches are arranged in a plane together with the surfaces of the surrounding areas.

11. The switch bank according to claim 10, wherein a reach-in opening is provided in the common switch housing for each of the plurality of rocker switches, such that an operator may reach under the free end of the rocker lever for adjusting the switch-on position.

12. The switch bank according to claim 10, wherein at least one rocker lever has a second switch-on position into which it is movable against a restoring force, the surface of the free end of the rocker lever dipping into the surrounding area of the switch housing in the second switch-on position.

13. The switch bank according to claim 10, wherein at least one rocker lever is bent at a right angle with respect to at least one of the longitudinal axis of the free end of the rocker lever and the longitudinal axis of the fixed end of the rocker lever.

* * * * *